United States Patent [19]

Crathern, III et al.

[11] 3,939,513

[45] Feb. 24, 1976

[54] PROCESS AND APPARATUS FOR BINDING

[75] Inventors: Charles F. H. Crathern, III, Contoocook; Sherman W. Twitchell, Hopkinton, both of N.H.

[73] Assignee: Crathern Engineering Co., Inc., Contoocook, N.H.

[22] Filed: Nov. 15, 1974

[21] Appl. No.: 523,976

[52] U.S. Cl. ..... 11/1 A

[51] Int. Cl. ..... B42c 19/00

[58] Field of Search ..... 11/1 R, 1 A; 281/21

[56] References Cited

UNITED STATES PATENTS

| | | | |
|---|---|---|---|
| 2,200,877 | 5/1940 | Farkas | 11/1 A |
| 3,038,180 | 6/1962 | Levitan | 11/1 A |
| 3,038,181 | 6/1962 | Nadherny | 11/1 A |
| 3,107,375 | 10/1963 | Byland et al. | 11/1 A |

*Primary Examiner*—Lawrence Charles
*Attorney, Agent, or Firm*—Schiller & Pandiscio

[57] ABSTRACT

The present invention relates to a system for binding of perforated sheets together through their perforations with at least one loop of flexible tape. The apparatus includes a tape feed station, a tape cut-off station, a tape loop forming station, and a tape loop sealing station. The various stations are interconnected and are activated in a series of interlocking cycles which together result in stringing or inserting a strip of flexible tape through each perforation, cutting the inserted tape to length, and looping the cut length around an adjacent edge of the stack of sheets. End portions of the looped lengths of tape are then sealed to close the loops and thereby form hinges. In a preferred embodiment of the invention, jets are provided to assist stringing the strip of tape through the perforations, and also to assist looping.

13 Claims, 13 Drawing Figures

PROCESS AND APPARATUS FOR BINDING

The present invention relates to a system for binding of stacks of sheets, and more particularly to apparatus and process for binding a stack of perforated sheets together through the perforations using at least one loop of flexible tape.

Flexible binding elements are well known in the art for binding a stack of sheets together. A typical prior art flexible binding element may comprise a relatively stiff plastic backbone from which a plurality of curled fingers project. The fingers have a certain degree of resiliency whereby they may be unrolled to some extent to permit insertion or removal of perforated sheets from the binder. The binder generally is preformed in its curled shape, so that the binder must be unrolled at the time of book assembly to permit insertion of the sheets. As a result book assembly is somewhat difficult and the binders are comparatively expensive.

It has also been proposed in the art to combine the assembling and binder curling operations. According to this latter method, a flat plastic binding element is inserted into the perforations, and simultaneously therewith the binding element is formed into a curled shape. With such method, the task of inserting the binder fingers through the sheets is somewhat simpler but the binder is nevertheless still comparatively expensive. Also, such systems typically require much more complicated apparatus to perform the combined assembling and curling operations, and thus typically are reserved mainly for large binderies which may handle a large volume of bindings.

It is thus a general object of the present invention to provide an improved system for binding together a stack of perforated sheets. A more specific object is to provide a process and apparatus for binding a stack of perforated sheets with a loop of flexible material such as plastic or polymeric tape.

A further object is to provide a process and apparatus of the character described which offers the advantages of relative simplicity, relative low cost, and ability to handle and bind a variety of shaped stacks of sheets.

Briefly described, in its preferred embodiment the present invention consists of providing a binding apparatus for forming flexible loop hinges to bind together a stack of perforated sheets that essentially comprise means for supporting a stack of perforated sheets so that their perforations are aligned, a tape supply and feed means for inserting or stringing a strip of flexible tape through the registered perforations; tape cutoff means for severing a length of tape from the tape supply including the portion thereof strung through the registered perforations; means for flexing the severed length of tape so that it forms a loop extending around an adjacent edge of the stack of sheets and through the perforations; and, means for sealing together end portions of looped lengths of tape. The various means are interconnected and are activated in a series of interlocking cycles which together result in the insertion of a predetermined length of strip of flexible tape through each perforation and looping of the strip around an adjacent edge of the stack of sheets. The end portions of the looped lengths of tape are then sealed to close the loops and thereby form flexible loop hinges.

Other objects and many of the attendant advantages of this invention are set forth in or rendered obvious by the following detailed description. The invention accordingly comprises the apparatus possessing the construction, combination of elements and arrangement of parts, which are exemplified in the following detailed description, and the scope of application of which will be indicated in the claims.

For a fuller understanding of the nature and objects of the present invention, reference should be made to the following detailed description taken in connection with the accompanying drawings in which like numerals depict like parts and wherein.

Figure 1:
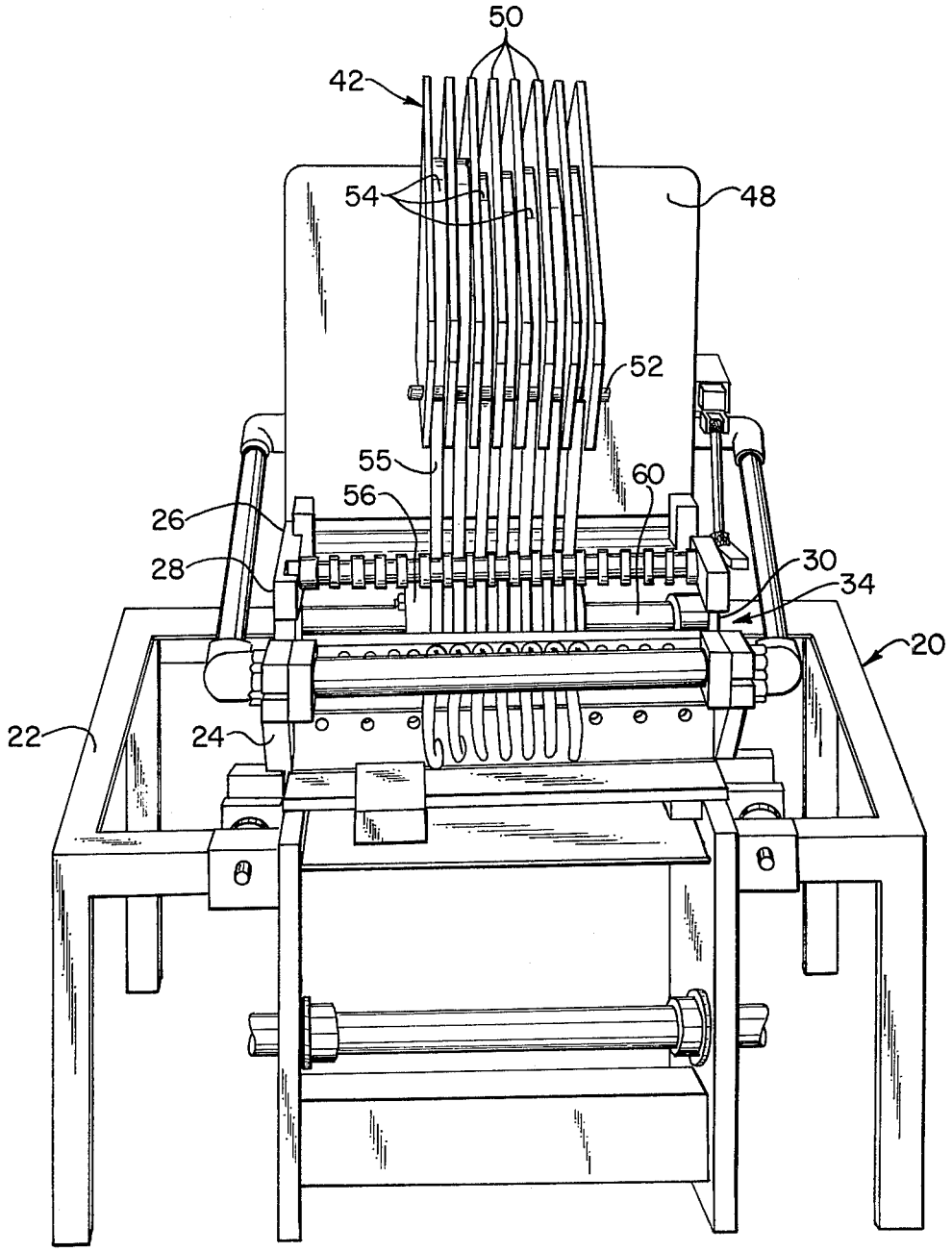
FIG. 1 is a perspective view of an apparatus consisting of a preferred embodiment of binding apparatus of invention.
Figure 2:
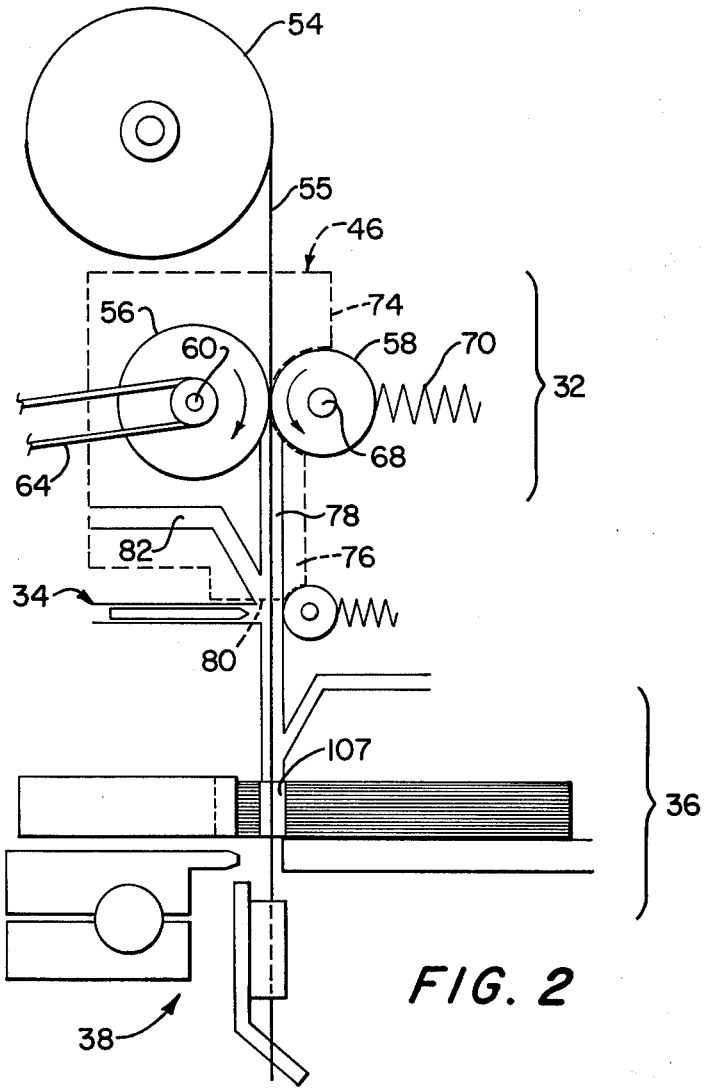
FIG. 2 is a side elevational view, partly in section, schematically showing some of the basic elements of the embodiment of FIG. 1, and the spatial relation of the elements to one another.
Figure 9:
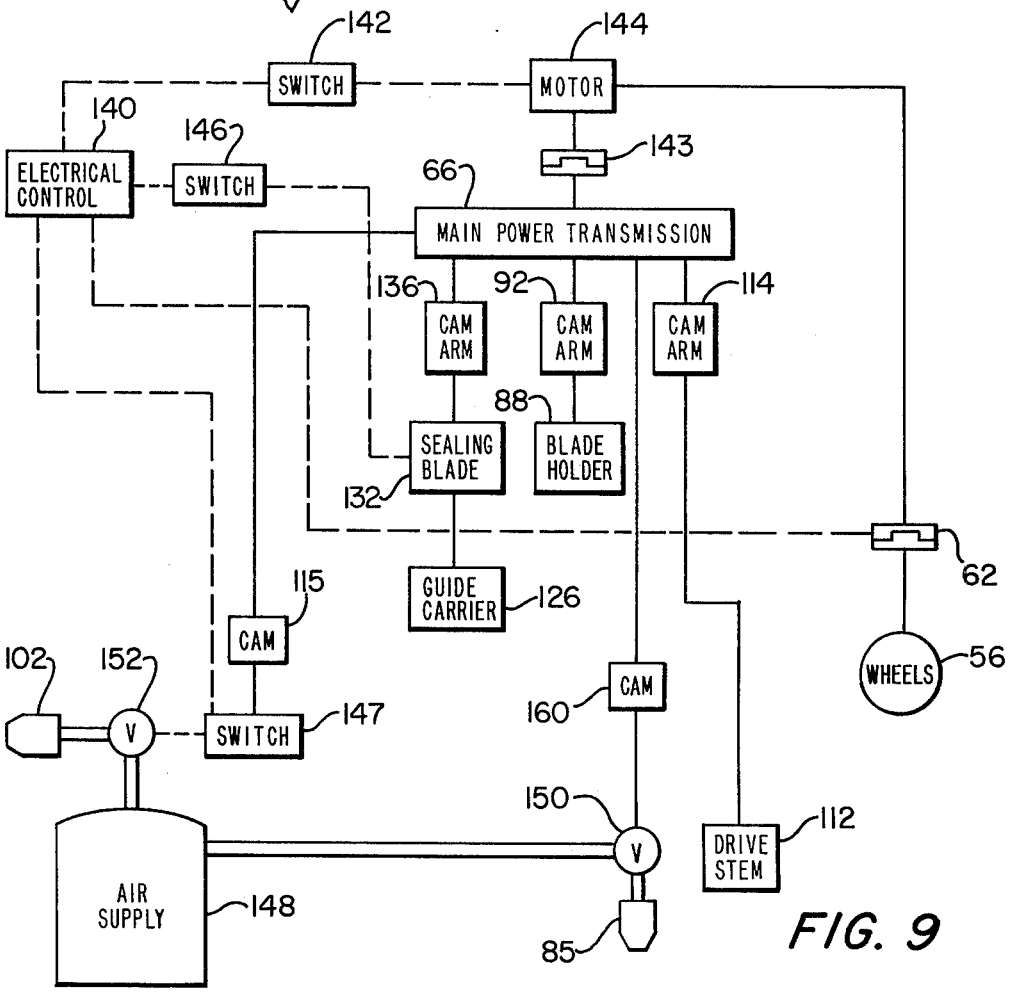
FIG. 9 is a schematic diagram of the electrical, mechanical and pneumatic control means of the same apparatus.
Figure 5:
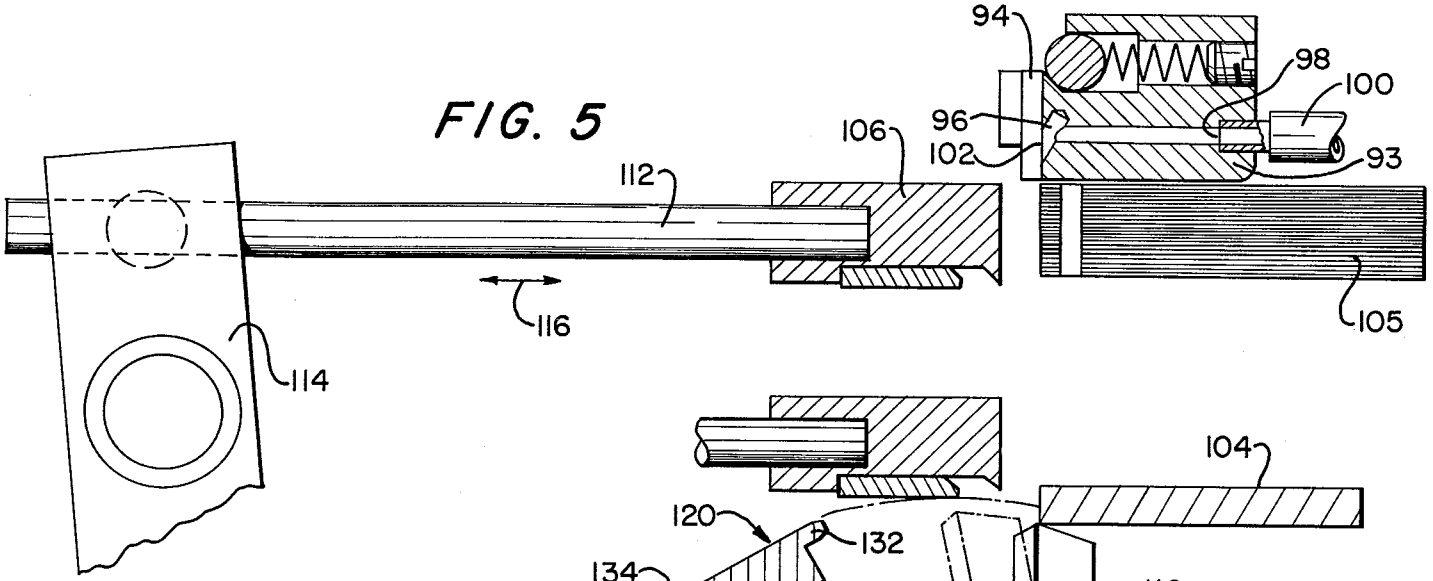
FIG. 5 is a side elevational schematic view, partly in section, of the basic elements of the tape looping means of the embodiment of FIG. 1.

Referring to FIGS. 1 and 2 of the drawings, there is illustrated a preferred embodiment of apparatus for applying binding loops to a stack of sheets. The apparatus comprises a frame in the form of a generally rectangular enclosure 20 having a horizontal base 22, generally vertical front and back frame members 24 and 26, respectively, and generally vertical side frame members 28 and 30. Disposed within the frame are a tape feed means 32, a tape cut-off means 34, tape looping means 36, and loop sealing means 38. Operation of the various elements of the apparatus is controlled by main power transmission 66 (FIG. 9).

Figure 3:
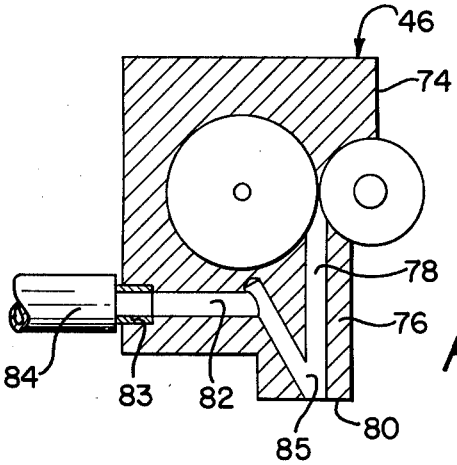
FIG. 3 is a side elevational schematic view, partly in section of the basic elements of the tape feed means of the embodiment of FIG. 1.

Referring now to FIGS. 1–3, tape feed means 32 comprises a bank of tape roll hoppers 42, disposed on vertical support plate 48, which in turn is mounted adjacent the top end of back frame member 26. Hoppers 42 comprise a plurality of flat, vertical plates 50 mounted on support plate 48. Tape roll support member 52 is disposed adjacent the bottom front edge of plates 50 perpendicular to the plane of plates 50. Plates 50 are spaced apart by a distance slightly greater than the width of the tape so that a single roll or supply reel 54 of tape may be loosely held in each hopper and a tape 55 unrolled from the reel in a manner well known in the art.

Disposed below hoppers 42 is a tape dispenser comprising a plurality of opposed driven wheels 56 and idler wheels 58. Driven wheels 56 are mounted on a horizontal drive shaft 60, the latter being mounted adjacent the top ends of vertical side frame members 28 and 30 on known bearing means (not shown) so that the latter is rotatable about the shaft axis. Drive shaft 60 in turn is mechanically coupled through a metering clutch 62 (FIG. 9) and drive belt 64 to the main power transmission 66 (FIG. 9). The latter in turn is driven by suitable power means such as an electric motor 144 (FIG. 9). Idler wheels 58 are mounted opposite driven wheels 56 on a horizontal shaft 68, the latter being rotatably mounted adjacent the top ends of vertical side frame members 28 and 30, with its axis parallel to the axis of shaft 60. Each pair of opposed wheels 56 and 58 is aligned in a path of the tape feed from hoppers 42. A plurality of springs 70 are provided for biasing shaft 68 towards shaft 60 so that idler wheels 58 will be pressed against driven wheels 56 with the tape 55 in the bite of the engaged wheels.

Advantages of the present invention which result from the use of flexible tape for forming the binding loops include low cost, and the ability to form books which lie flat. On the other hand because tape 55 is flexible, this presents a problem in feeding the tape through the tube formed by a registered perforations in a plurality of sheets. The present invention solves this problem by the provision of tape threading or stringing means comprising one or more pneumatic bearing blocks 46 which are located in the path of the tape feed from hoppers 42 through opposed driven wheels 56 and idler wheels 58, and also surrounding the drive wheels and idler wheels, at least in part. Blocks 46 are partially supported by drive shaft 60, and the blocks are also supported in part on the vertical front frame member 24 so that the blocks are maintained in a predetermined fixed position relative to each other and to wheels 56 and 58.

Referring to FIGS. 2 and 3, bearing blocks 46 are generally rectangular in shape, with a generally rectangular projection 74 on one side edge adjacent the top of the block, and a rectangular projection 76 on the bottom edge of the block, adjacent the same one side. An elongate passage or slot 78 in the block runs vertically through the block as a continuation of the tape feed path from adjacent opposed wheels 56 and 58 to the bottom edge 80 of the block at projection 76. Slot 78 has a generally rectangular cross section and is slightly wider than the width of the tape 55 so that the latter may be threaded through the slot.

A second elongate passage or tube 82 is provided in the block adjacent the bottom of the block. One end 83 of passage 82 is connected through a conduit 84 and a valve to a source of positive pressure fluid such as air as will be hereinafter described. The other end 85 of passage 82 is formed as an air jet, and is directed generally downwardly at an angle to the direction of elongation of passage 78, and communicates with this latter passage adjacent its bottom end, i.e. in projection 76.

Figure 4:
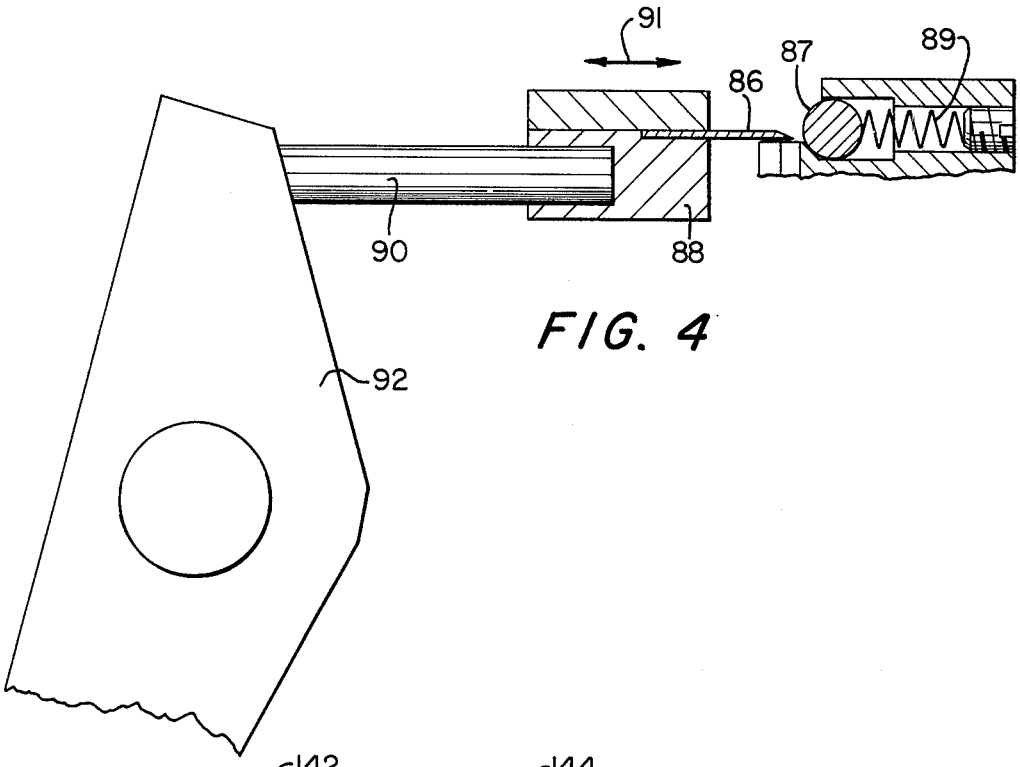
FIG. 4 is a side elevational schematic view, partly in section, of the basic elements of the tape cut-off means of the embodiment of FIG. 1.

Referring to FIGS. 2 and 4, the tape cut-off station 34 is disposed directly below the bank of bearing blocks 46 adjacent the end of passages 78. The cut-off station includes a cutting blade 86 which is disposed directly below the end of passage 78 on one side of the passage, and a cooperating anvil 87 disposed directly below the end of the passage and on the other side of the passage. Cutting blade 86 comprises a flat, rigid knife edge that is affixed in horizontal alignment to a blade holder 88. The latter is carried on a horizontally reciprocating push rod or drive stem 90 which in turn is mechanically coupled through a cam arm 92 to the main power transmission 66. By this arrangement the cutting blade 86 may be moved back and forth in a horizontal direction, i.e. along the lines of arrows 91, in and out of contact with anvil 87. However, when drive stem 90 is retracted, the cutting blade 86 should be spaced from anvil 87 by an amount sufficient to allow the tape end 55 to be moved into the intervening space, as will be described in detail below. Anvil 87 is mounted on a biasing spring 89 which in turn is fixed to frame back member 26.

Referring to FIGS. 2 and 5 – 7 the tape looping means 36 is disposed directly below the cut-off means 34. Looping means 36 includes one or more "Y" shaped hollow members 93 in which a vertical elongate passage or tube 94 is aligned as an extension of passage 78. A second arm of the "Y" is formed by a second passage or tube 96. One end 98 of passage 96 is connected through conduit 100 and a valve to a source of positive pressure fluid such as air as will be hereinafter described. The other end 102 of passage 96 is formed as an air jet, and is directed generally downwardly at an angle to the direction of elongation of passage 94, and communicates with this latter passage adjacent its bottom end.

Figure 6:
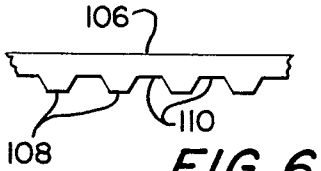
FIG. 6 is a top plan view of a portion of the looping means of FIG. 5.

Looping means 36 also includes a generally horizontal table or support 104 for supporting a stack of perforated sheets to be bound 105, and a bearing block or comb 106. As seen in FIG. 11A, the sheets are gathered so that their perforations 107 are aligned with the perforations continuing as a vertical extension of passage 94 when comb 106 is in its retracted position as will be described in detail hereinafter. Comb 106 has a plurality of tines 108 and spaces 110 (FIG. 6). Tines 108 are spaced apart a distance slightly greater than the width of the tape 55. The comb is disposed adjacent the lower end of member 93 and is aligned so that spaces 110 continue as a vertical extension of passage 94 when the comb is in its forward position as will be described in detail hereinafter. Comb 106 is mounted on a horizontally reciprocating push rod or drive stem 112 which in turn is mechanically coupled through a cam arm 114 to the main power transmission 66. By this arrangement comb 106 may be moved back and forth in a horizontal direction, i.e. along the lines of arrows 116, from a retracted position as seen in FIG. 11A to a forward position as seen in FIG. 11B, and as will be described in detail hereinafter.

Figure 7:
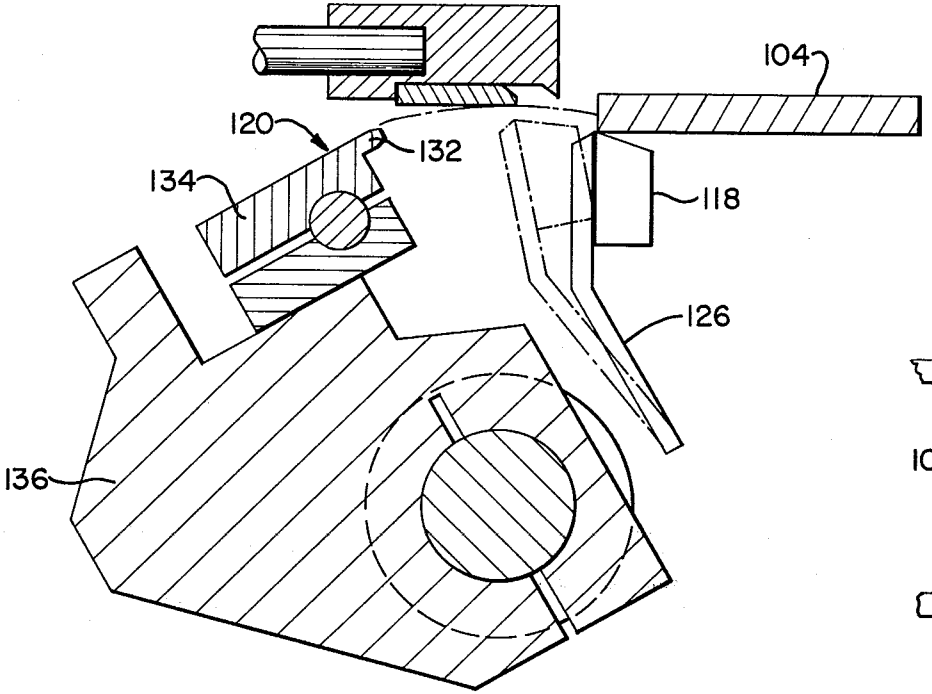
FIG. 7 is a side elevational schematic view, partly in section, of the basic elements of the loop sealing means of the embodiment of FIG. 1.
Figure 8:
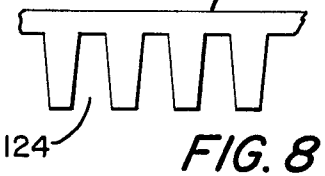
FIG. 8 is a top plan view of a portion of the loop sealing means of FIG. 7.

Referring to FIGS. 2, 7 and 8, the loop sealing means 38 includes a tape lower guide 118 and a sealing head indicated generally at 120. Lower guide 118 is in the form of a slotted or ribbed block 122, having a plurality of slots 124, each of which is slightly wider than the tape 55. As seen in FIG. 8, slots 124 are beveled or tapered so that the slots are widest at their open ends, whereby to assist in gathering the tape ends 55 as will be described in detail hereinafter. Block 122 is mounted so that slots 124 are aligned with and continue as a vertical extension of the tape path from the tape feed through the looping means 36, etc. The block is mounted on a guide carrier member 126 which in turn is mounted for pivotal movement on a horizontal axis. The carrier member 126 is mechanically coupled through cam arm 136 (FIG. 9) to main power transmission 66.

Typically, the tape will comprise a thermoplastic polymer in which case sealing head 120 preferably will comprise a flat, rigid heated blade 132, which is carried in horizontal alignment on a blade mount 134. The latter is mounted for pivotal movement on a horizontal axis, and is mechanically coupled through a cam arm 136 to the main power transmission 66. Alternatively, blade 132 and blade mount 134 may be mounted for horizontal reciprocating movement, e.g. as shown in FIGS. 11A, B, C. Blade 132 is heated by any suitable heat source well known in the art such as by an electrical resistance heater formed integrally therewith (not shown).

FIG. 9 schematically ilustrates the electrical, mechanical and pneumatic control system of the apparatus of the present invention. In this figure the dotted lines represent electrical circuit connections; the single solid lines represent mechanical connections; and, the double solid lines suggest tubes or hose lines for conducting fluid or air.

The electrical control system 140 includes a switch 142 for controlling operation of an electric motor 144 switch 146 for operating heated blade 132; and a switch 147 responsive to cam 115 for operating an air valve 152. The electrical control system 140 preferably is constructed to provide automatically operated modes of operation.

The pneumatic control system includes a pressurized air source 148 that is connected via an air valve 150 to air jet 85, and via an air valve 152 to air jet 102.

Figure 10:
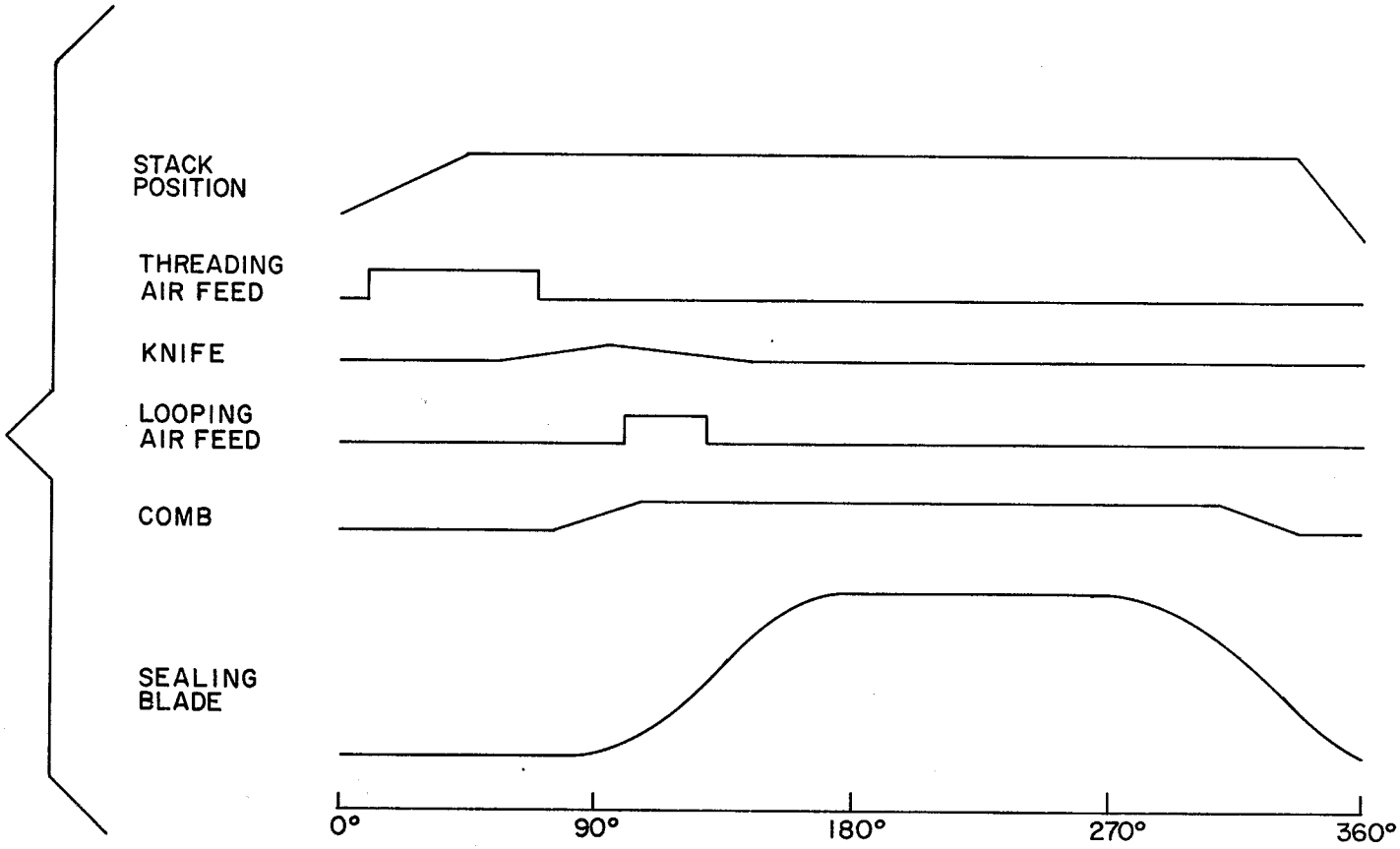
FIG. 10 is a schematic diagram of the timing control and power drive system for the same apparatus.

The mechanical connection control system includes a main power transmission 66 which is connected via a clutch 143 to an electric motor 144. Electric motor 144 is connected to a clutch 62 which controls driven wheels 56. Main power transmission 66 is also connected to a cam arm 92 which in turn controls the movement of blade holder 88; a cam arm 114 which controls movement of drive stem 112; a cam 115 connected to switch 147 which in turn controls valve 152; a cam 160 which controls valve 150; and, a cam arm 136 which controls movement of the heated blade 132, and guide carrier 126. The various electrical, mechanical and pneumatic controls of the apparatus are actuated in a timed series of interlocking cycles as shown in FIG. 10 in which one complete rotation (360°) of the main power drive represents one complete cycle. It is believed that further details of the electrical, mechanical and pneumatic control system are not required to be described in order to permit a person skilled in the art to practice the invention and it is to be understood that the control system and the various elements controlled thereby may take various obvious forms to persons skilled in the art.

Figure 11C:
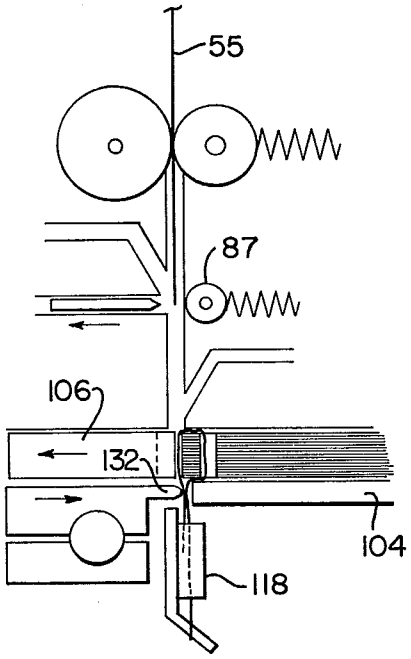
FIG. 11 is a series of schematic diagrams showing the apparatus of the present invention at various operational stages.
Figure 11B:
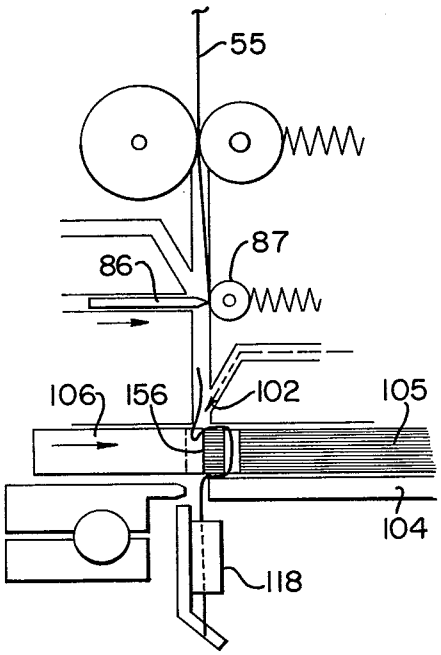
Figure 11A:
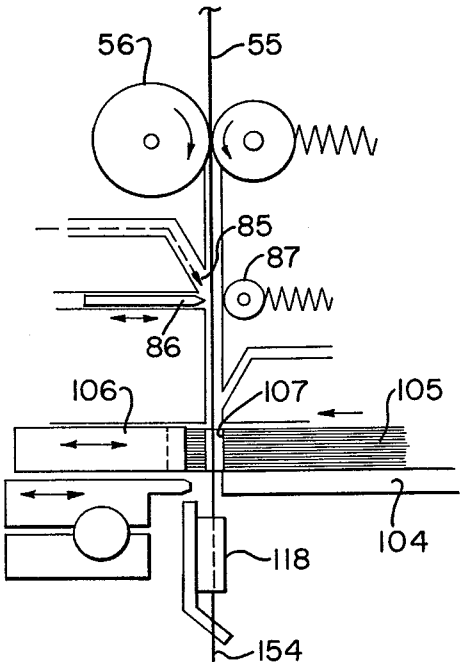

Referring to FIGS. 11A–11C, one way of operating the foregoing apparatus will now be described. A stack of sheets 105 each having a plurality of perforations adjacent one edge are gathered in a stack so that at least one perforation in each sheet is registered with a corresponding perforation in each of the other sheets. The gathered stack is inserted into the apparatus in a manner such that the stack edge having the aligned perforations is brought up tight against comb 106. The latter is moved to its fully retracted position, e.g. as in FIG. 11A.

Driven rolls 56 are activated to feed a predetermined length of tape 55 into tube 78. During this operation valve is opened to allow air to flow through jet 85. As a result the tape free end 154 is carried or strung through slots 78 and perforations 107, and assumes a position adjacent the bottom of tail guide 118.

Referring to FIG. 11B, once the predetermined length of tape is fed into the apparatus, the feed rolls are stopped, and the positive air flow through jet 85 is discontinued. Cut-off blade 86 is now moved into cutting position against anvil 87 by activation of drive stem 90. At the same time comb 106 is moved forward thereby pushing the stack of sheets 105 with the comb, and the tape is trapped between the edge of the table 104 and the edge of the stack of sheets 105. As a result each length of tape is cut by blade 86 and severed from its corresponding supply reel.

Once the tape lengths have been cut and severed from their corresponding supplies, air valve 152 is opened to allow air to flow through jet 102. This latter flow of air flexes the free cut ends of tape 55 down through the spaces provided between the tines of comb 106, and thereby to form a loop extending around edge 156 of the stack of sheets.

Air valve 152 is then closed, and while the comb 106 is still in the extended position as in FIG. 11B, lower guide carrier 118 and heated blade 132 are moved by activation of cam arm 136 towards table 104, to sealing position as shown in FIG. 11C. The tape free ends are aligned by guide 118, and the end portions are sealed by thermal fusion to thereby form a loop. If desired, any tape excess end portions may also be removed from the looped lengths of tape simultaneously with the fusing. Once the looped lengths of tape are sealed, lower guide carrier 118 and sealing blade 132 are withdrawn to their retracted positions (FIG. 11B) and the cycle is completed. A book comprising a stack of sheets with hinges formed from loops of flexible tape results. The book is then removed from the apparatus, a new stack of sheets may be inserted into the apparatus and the cycle repeated.

Certain changes may be made in the above apparatus without departing from the scope of the invention herein involved as will be obvious to one skilled in the art. For example, the tape sealing means 36 may comprise means for mechanically joining end portions of the looped lengths of tape, as for example, by crimping or with a staple. Alternatively, the tape end portions may be joined together chemically, e.g. as by a solvent, or by means of an adhesive, in which case the tape sealing means 36 may comprise means for applying a quantity of a selected solvent or adhesive to the tape end portions. Still other changes will be obvious to one skilled in the art, and it is therefore intended that all matter contained in the above description shall be interpreted in an illustrative and not in a limiting sense.

What is claimed is:

1. Apparatus for binding a stack of perforated sheets together at one edge with at least one loop of flexible tape, said apparatus comprising in combination:

means for supporting said stack of said perforated sheets so that at least one perforation in each sheet is registered with a corresponding perforation in each of the other sheets;

means for pneumatically stringing said tape from a substantially continuous supply thereof through said registered perforations;

cut-off means for severing from said supply a length of tape including the portion thereof strung through said registered perforations;

forming means for flexing said length of tape so that the latter forms a loop extending around an adjacent edge of said stack of sheets and through said registered perforations; and means for sealing together end portions of said looped length of tape.

2. Apparatus as claimed in claim 1 wherein said means for stringing said tape comprises:

at least one bearing block defining an elongate path for said tape, and having pneumatic means for driving said tape through said elongate path in said block in the direction of elongation, and also through said registered perforation.

3. Apparatus as claimed in claim 2 wherein said pneumatic means for driving comprises a jet and a source of positive pressurized fluid connected to said jet.

4. Apparatus as claimed in claim 3 including a valve for permitting a flow of pressurized fluid through said jet for a predetermined time.

5. Apparatus as claimed in claim 1 wherein said tape cut-off means is disposed below said tape feed means.

6. Apparatus as claimed in claim 5 wherein said knife blade is adapted for movement between a first open position and a second cutting position.

7. Apparatus as claimed in claim 1 wherein said tape flexing means comprises an elongate passage disposed below said cut-off means, and including a jet disposed intermediate the ends of said passage, a source of positive pressurized fluid connected to said jet, and a valve for permitting a flow of pressurized fluid through said jet for a predetermined time.

8. Apparatus as claimed in claim 7 wherein said tape flexing means also includes a slotted comb means which is adapted for movement between a first retracted position, and a second forward position in which said slots define an extension of said elongate passage.

9. Apparatus as claimed in claim 1 wherein said tape comprises a thermoplastic material, and said means for sealing comprises heating means.

10. Apparatus as claimed in claim 9 wherein said sealing means comprises a heated blade which is adapted for movement between a first open position and a second sealing position.

11. Apparatus as claimed in claim 10 wherein said sealing means also includes a slotted guide to assist gathering the end portions of tape and hold the end portions in alignment while said heated blade is moved to said sealing position.

12. A process for binding a stack of perforated sheets together at one edge with at least one loop of flexible tape, said process comprising in combination:

supporting said stack of said perforated sheets so that at least one perforation in each sheet is registered with a corresponding perforation in each of the other sheets;

pneumatically stringing said tape from a substantially continuous supply thereof through said registered perforation;

severing from said supply a length of tape including the portion thereof strung through said registered perforations;

flexing said length of tape so that the latter forms a loop extending around an adjacent edge of said stack of sheets and through said registered perforations; and sealing together end portions of said looped length of tape.

13. A process as claimed in claim 12 wherein said tape comprises a polymeric tape.

* * * * *